US008096682B2

(12) United States Patent
Lin et al.

(10) Patent No.: US 8,096,682 B2
(45) Date of Patent: Jan. 17, 2012

(54) LED LIGHTING DEVICE

(75) Inventors: Ming Feng Lin, Shenzhen (CN); Wei Wang, Shenzhen (CN); Ping Lin Zhao, Shenzhen (CN); Song Lei, Shenzhen (CN)

(73) Assignee: Unilumin Group, Co., Ltd., Shenzhen (CN)

( * ) Notice: Subject to any disclaimer, the term of this patent is extended or adjusted under 35 U.S.C. 154(b) by 0 days.

(21) Appl. No.: 12/778,170

(22) Filed: May 12, 2010

(65) Prior Publication Data

US 2011/0176311 A1 Jul. 21, 2011

(30) Foreign Application Priority Data

Jan. 15, 2010 (CN) ..... 2010 2 0056629 U

(51) Int. Cl.
*F21V 33/00* (2006.01)

(52) U.S. Cl. ..... 362/249.02; 362/217.07; 362/225

(58) Field of Classification Search ..... 362/249.02, 362/249.06, 217.01, 225
See application file for complete search history.

(56) References Cited

U.S. PATENT DOCUMENTS

| | | | | |
|---|---|---|---|---|
| 5,400,228 | A * | 3/1995 | Kao | 362/231 |
| 7,011,430 | B2 * | 3/2006 | Chen | 362/235 |
| 7,040,790 | B2 * | 5/2006 | Lodhie et al. | 362/541 |
| 7,549,772 | B2 * | 6/2009 | Wang | 362/294 |
| 2009/0213575 | A1 * | 8/2009 | Blumel et al. | 362/97.3 |
| 2010/0053966 | A1 * | 3/2010 | Tu et al. | 362/249.02 |

* cited by examiner

*Primary Examiner* — Laura Tso

(57) ABSTRACT

An LED lighting device includes a receptacle comprising first and second bossed holes each having internal threads, and two opposite shoulders each formed lengthwise along a central line of an inner surface of either side of the receptacle; a cover plate comprising apertures and threadedly secured to the receptacle to form a housing; PCBs each supported by the shoulder and the first bossed holes and fastened in the receptacle by driving threaded fasteners therethrough into the first bossed holes; parallel elongated members each with the housing mounted thereon; units of LEDs electrically connected to the PCB wherein each unit of LEDs is fastened in the aperture; a waterproofing member filled in the housing for protecting the PCB; longitudinal and transverse frame members mounted on one surfaces of the elongated members; and a panel box mounted on the frame members, the panel box being electrically connected to the PCBs.

2 Claims, 5 Drawing Sheets

LED LIGHTING DEVICE

BACKGROUND OF THE INVENTION

1. Field of Invention

The invention relates to LED (light-emitting diode) lighting devices and more particularly to an LED lighting device (e.g., LED display) with improved characteristics.

2. Description of Related Art

LEDs are widely employed in many applications. For example, there are large LED displays, LED destination displays, information signs, etc. available. A typical LED display comprises a housing, a PCB (printed circuit board) in the housing, one or more LEDs in the housing and electrically connected to the PCB, and a transparent cover secured to the housing. Waterproof adhesive is further applied to joining portion of the housing and the cover if the LED displays are for outdoor applications.

However, a number of drawbacks have found in the typical LED displays. For example, such LED displays are primarily for billboards having a distance of no more than 25 mm between any two adjacent LEDs. Hence, they are not appropriate for large LED displays because of the following reasons: (a) Heavy weight. This is because PCB, housing, and cover are enlarged for accommodating LEDs in which distance between any two adjacent ones is no more than 25 m. Further, more waterproof adhesive is required. This in turn can bring inconvenience to assembly or disassembly. Further, it can significantly increase the manufacturing cost. (b) Noise making. This is because a high power fan is required at the site of installation. Hence, it is not appropriate for indoor applications. (c) Wind barrier. Large LED displays can prohibit wind from passing through. For achieving this goal, reinforced additional structural members are required. This, however, can increase the manufacturing cost and make it more complicated. Thus, the need for improvement still exists.

SUMMARY OF THE INVENTION

It is therefore one object of the invention to provide an LED lighting device comprising a receptacle comprising a plurality of first and second bossed holes each having internal threads, and two opposite shoulders each formed lengthwise along a central line of an inner surface of either side of the receptacle; a cover plate comprising a plurality of apertures and threadedly secured to the receptacle to form a housing; a plurality of PCBs each supported by the shoulder and the first bossed holes and fastened in the receptacle by driving a plurality of threaded fasteners therethrough into the first bossed holes; a plurality of parallel elongated members each with the housing mounted thereon; a plurality of units of LEDs electrically connected to the PCB wherein each unit of LEDs is fastened in the aperture; waterproofing means in the housing for protecting the PCB; a plurality of longitudinal and transverse frame members mounted on one surfaces of the elongated members; and a panel box mounted on the frame members, the panel box being electrically connected to the PCBs.

The above and other objects, features and advantages of the invention will become apparent from the following detailed description taken with the accompanying drawings.

DETAILED DESCRIPTION OF THE INVENTION

Figure 1:
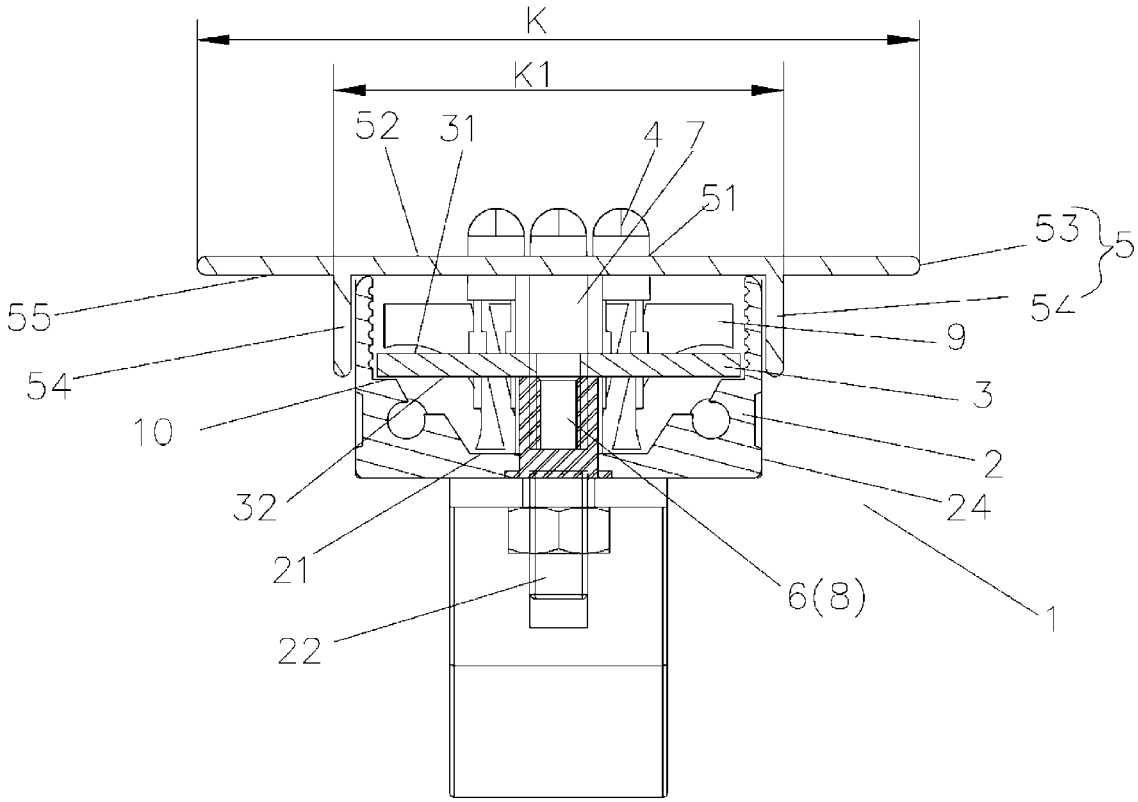
FIG. 1 is a sectional view of an LED unit mounted in a housing according to the invention.
Figure 2:
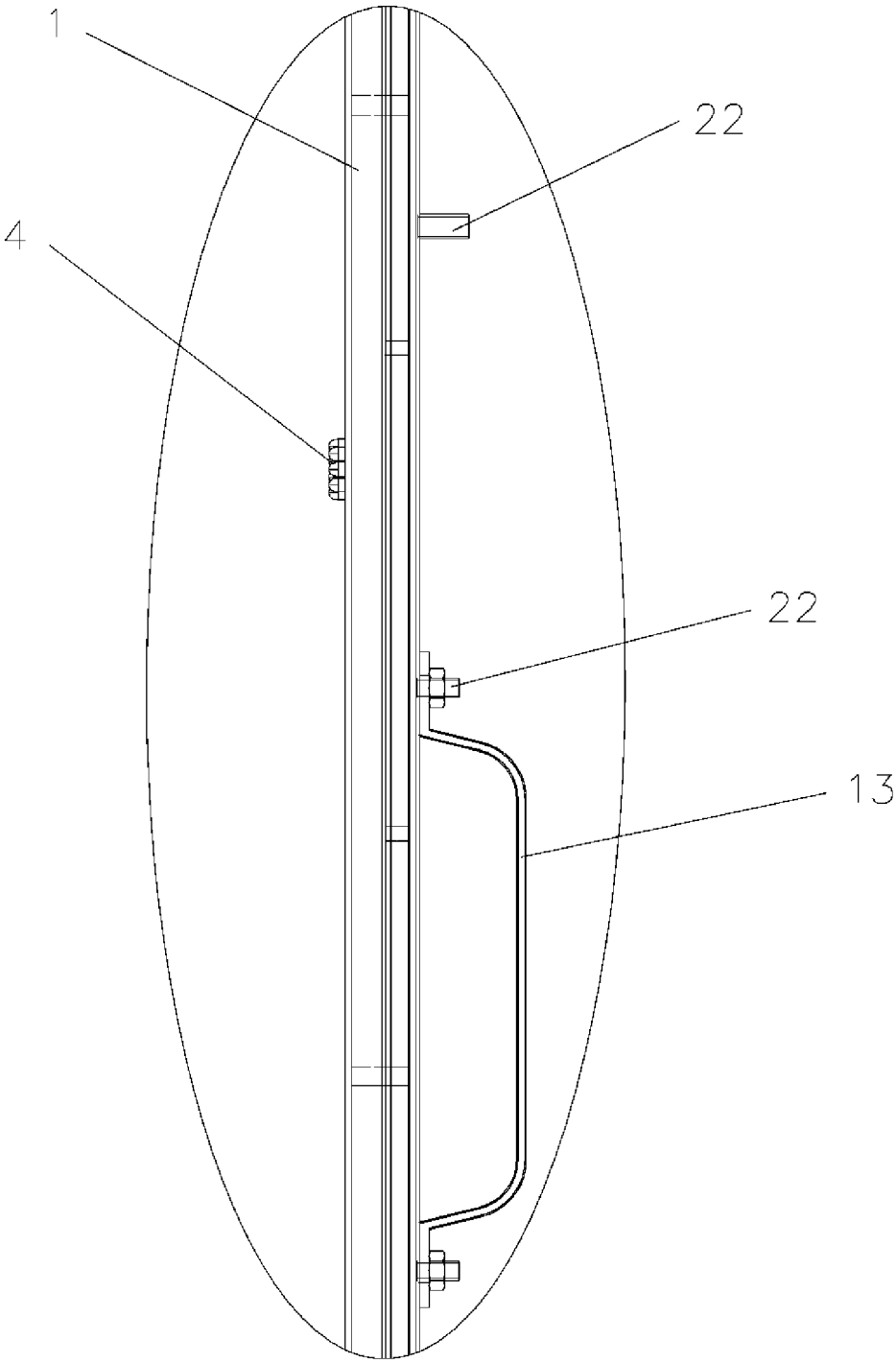
FIG. 2 is an enlarged side view showing the LED unit and adjacent parts.

Referring to FIGS. 1 to 5, an LED lighting device in accordance with the invention comprises the following components as discussed in detail below.

A rectangular receptacle 2 has a bottom 21 and two sides 24. A plurality of first and second bossed holes 6, 7 are provided in the receptacle 2. A cover plate 5 has a plate member 53 and two side members 54 perpendicular to the plate member 53. Width K of the plate member 53 is greater than a distance K1 between the two side members 54. The plate member 53 has a top surface 52, a bottom surface 55, and a plurality of apertures 51.

Two opposite shoulders 10 each forms lengthwise along a central line of an inner surface of either side 24. Bottom surface 32 of one of a plurality of printed circuit boards (PCBs) 3 is supported by the first bossed holes 6 and the shoulders 10. Also, the second bossed holes 7 pass the bottom surface 32 and top surface 31 of the PCB 3 to urge against a bottom surface 55 of the plate member 53. External power can be supplied to the PCB 3 by inserting a plug (not shown) into a socket 23 on a lower portion of one of a plurality of parallel elongated members 1 each with a plurality of LED units mounted thereon. The socket 23 is electrically connected to the PCB 3.

A plurality of threaded fasteners (e.g., screws) 8 can be driven into internal threads of the second bossed holes 7 to fasten the cover plate 5 and the receptacle 2 together. A plurality of threaded fasteners (e.g., screws) 8 can be driven into internal threads of the first bossed holes 6 to fasten the PCB 3 within the receptacle 2.

Each LED unit comprises a plurality of LEDs 4. Each LED unit is mounted in the aperture 51. LEDs 4 are electrically connected to the PCB 3. A plurality of threaded bolts 22 are provided along the one surface of the elongated member 1. Two fasteners (e.g., nuts) can be employed to secure a handle 3 onto the plate 1 by threadedly securing both ends of the handle 13 onto the elongated member 1.

Figure 3:
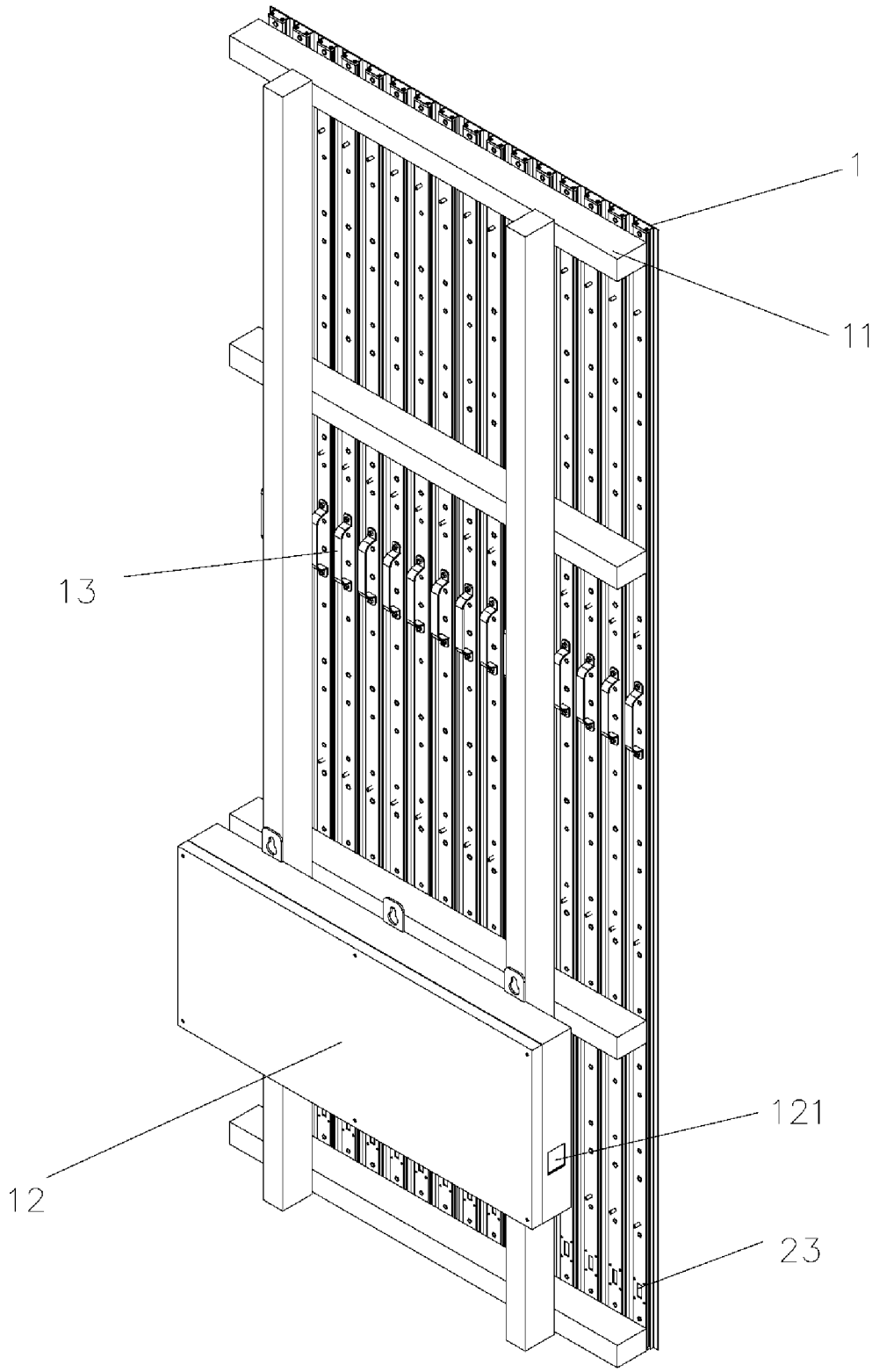
FIG. 3 is a perspective view of an LED according to the invention.
Figure 4:
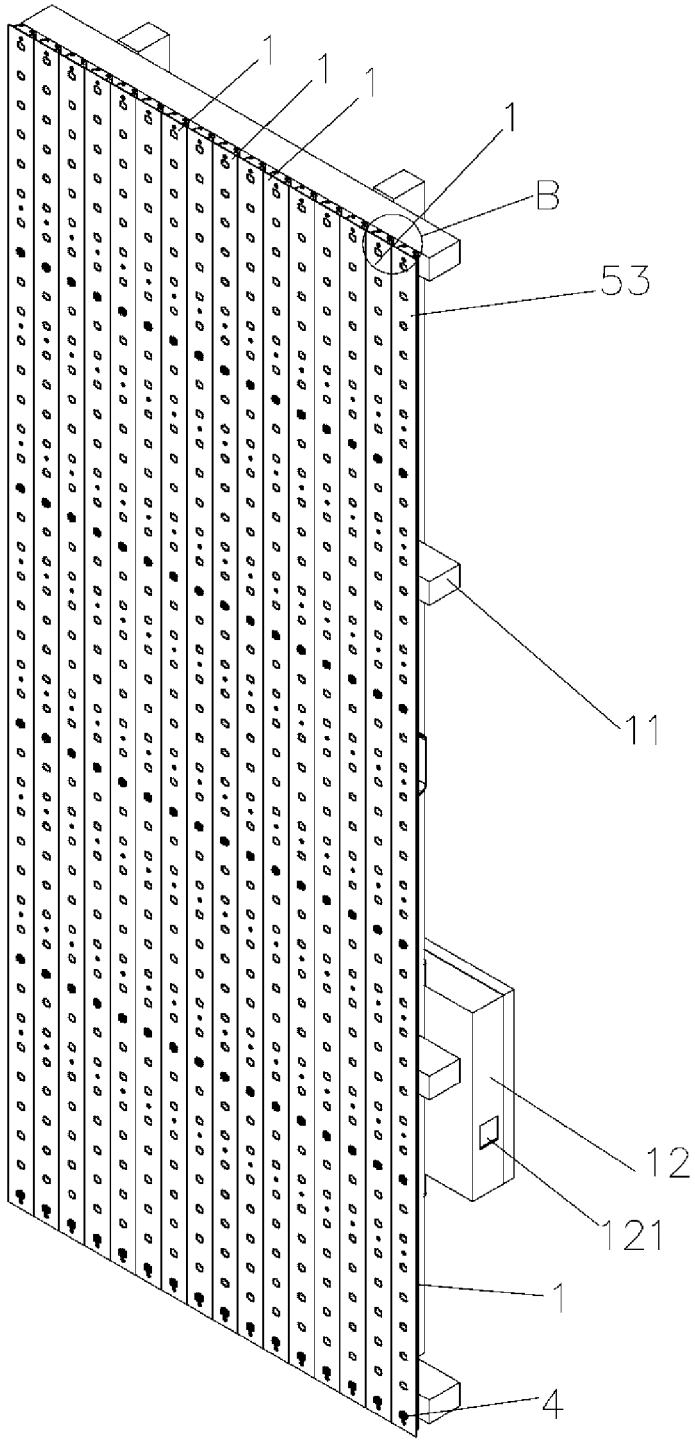
FIG. 4 is another perspective view of LED lighting device but viewing from the opposite end.
Figure 5:
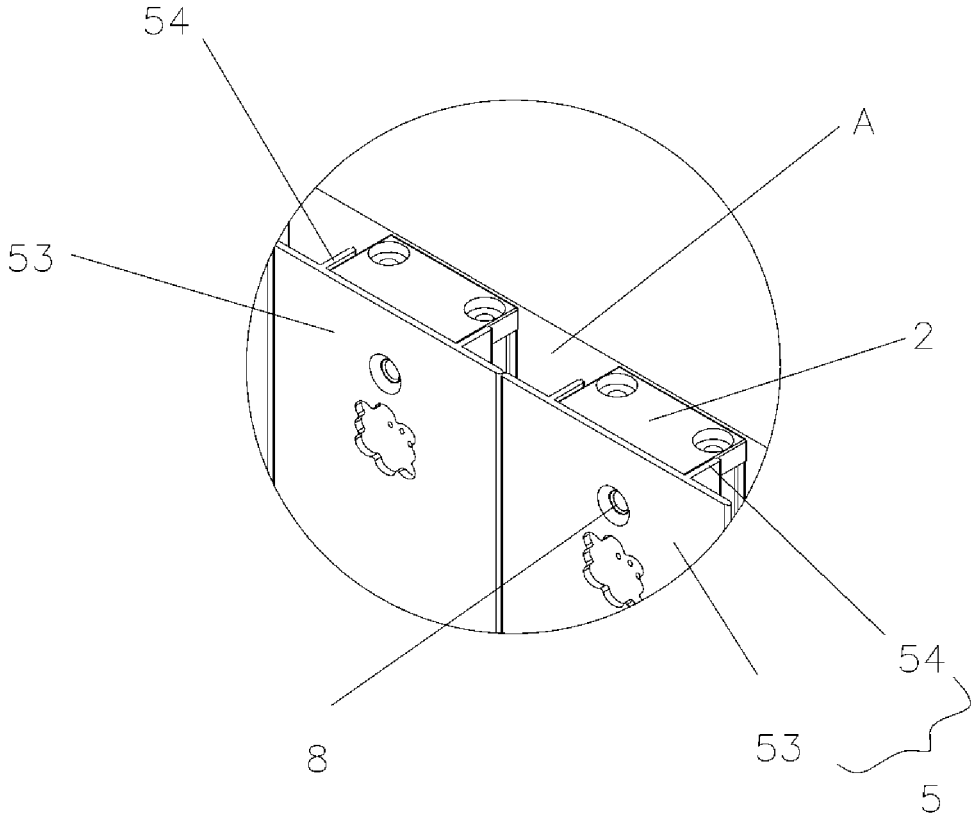
FIG. 5 is a detailed view of the circle B in FIG. 4.

A plurality of longitudinal and transverse frame members 11 are mounted on one surfaces of the elongated members 1. A rectangular panel box 12 is mounted on the frame members 11. The panel box 12 has a plurality of openings 121 (only one is shown in FIG. 3). Wiring can be installed to electrically interconnect the socket 23 and power and circuitry (both not shown) in the panel box 12. Thus, the LEDs 4 can be activated when power is supplied thereto from the panel box 12.

The assembly of the LED lighting device can be briefed as below. First, assemble the PCB 3 in the receptacle 2. Next, fill interior of the receptacle 2 with waterproof epoxy adhesive 9 for further fastening the PCB 3 and preventing water from entering the receptacle 2. Otherwise, it may cause short circuit. Next, secure the cover plate 5 onto the receptacle 2. A complete LED lighting device is assembled. Finally, mount the LED lighting device on, for example, a wall.

For reducing weight and the manufacturing cost, both the receptacle 2 and the cover plate 5 are made of aluminum. Other lightweight materials for the receptacle 2 and the cover plate 5 are also contemplated by the invention. The threaded bolts 22 can be driven into the frame members 11 for mounting the LED lighting device thereon.

While the invention has been described in terms of preferred embodiments, those skilled in the art will recognize that the invention can be practiced with modifications within the spirit and scope of the appended claims.

What is claimed is:

1. An LED lighting device comprising:

a plurality of receptacles (2) each comprising a plurality of first bossed threaded holes (6), a plurality of second bossed threaded holes (7), and two opposite shoulders (10) each formed lengthwise along a central line of an inner surface of either side of the receptacle (2);

a plurality of cover plates (5) each comprising a plurality of apertures (51) and threadedly secured to the receptacle (2);

a plurality of printed circuit boards (PCBs) (3) each supported by the shoulder (10) and the first bossed threaded holes (6) and fastened in the receptacle (2) by driving a plurality of threaded fasteners (8) therethrough into the first bossed threaded holes (6);

a plurality of units of three light-emitting diodes (LEDs) (4) electrically connected to the PCBs (3) wherein each unit of three LEDs (4) is fastened in the aperture (51) of the cover plate (5);

a plurality of parallel elongated members (1) each with the receptacle (2) and the cover plate (5) mounted thereon;

a plurality of longitudinal and transverse frame members (11) mounted on one surfaces of the elongated members (1); and a panel box (12) mounted on the frame members (11), the panel box (12) being electrically connected to the PCBs (3).

2. The LED lighting device of claim 1, wherein both the receptacles (2) and the cover plates (5) are formed of aluminum.

* * * * *